US006073458A

United States Patent [19]

Kim

[11] Patent Number: 6,073,458

[45] Date of Patent: Jun. 13, 2000

[54] APPARATUS AND METHOD FOR SUPPLYING COOL AIR TO THE INTERIOR OF A REFRIGERATOR

[75] Inventor: Seok Ro Kim, Changwon, Rep. of Korea

[73] Assignee: LG Electronics Inc., Seoul, Rep. of Korea

[21] Appl. No.: 09/137,111

[22] Filed: Aug. 20, 1998

[30] Foreign Application Priority Data

Aug. 29, 1997 [KR] Rep. of Korea ..... 97-42672

[51] Int. Cl.[7] ..... F25D 17/04

[52] U.S. Cl. ..... 62/186; 62/255; 62/408; 62/418; 454/195

[58] Field of Search ..... 62/186, 408, 407, 62/417, 418, 255; 236/51; 454/195

[56] References Cited

U.S. PATENT DOCUMENTS 5,584,191 12/1996 Kwon .
5,642,628 7/1997 Whipple, III et al. ..... 62/186
5,809,798 9/1998 Clarke et al. ..... 62/408
5,816,061 10/1998 Lee et al. ..... 62/187
5,826,437 10/1998 Kim ..... 62/186

*Primary Examiner*—Henry Bennett
*Assistant Examiner*—Marc Norman

[57] ABSTRACT

A concentrated cool air supply device for refrigerators is disclosed. In the device, a branch duct is branched from the cool air passage to guide the cool air to the door. A door duct is formed on the door to receive the cool air from the branch duct. The door duct has a plurality of air outlet openings on a cover plate. The outlet openings of the door duct are selectively opened by a slide panel, thus concentrically discharging the cool air from the door duct into a desired portion of the compartment. In order to move the slide panel, the device also has a motor, a rotatable link and a connecting rod. The link is coupled to the motor, thus being selectively rotated by the motor, while the connecting rod is connected to the link and the slide panel at both ends.

12 Claims, 5 Drawing Sheets

APPARATUS AND METHOD FOR SUPPLYING COOL AIR TO THE INTERIOR OF A REFRIGERATOR

BACKGROUND OF THE INVENTION

1. Field of the Invention

The present invention relates, in general, to supplying cool air in devices for refrigerators and, more particularly, to a supplying concentrated cool air device for capable of concentrically guiding cool air from a door duct to a hot area, newly loaded with foodstuffs, inside the fresh compartment of a refrigerator, thus more effectively cooling such a hot area.

2. Description of Related Art

The construction of a typical refrigerator is shown in FIG. 1. As shown in the drawing, a typical refrigerator comprises two compartments: a freezer compartment 2 and a fresh compartment 4. In order to supply cool air from an evaporator 5 to both compartments 2 and 4, a cool air supply device is provided in the refrigerator. That is, a portion of the cool air from the evaporator 5 is forcibly guided into the freezer compartment 2 by a blower 7. In order to guide the remaining part of the cool air from the evaporator 5 to the fresh compartment 4, a cool air duct 9 is arranged on the rear wall of the fresh compartment 4.

The amount of cool air for the fresh compartment 4 is controlled by a damper device (not shown) provided on the top portion of the duct 9. The damper device is operated in response to output signals from a plurality of temperature sensors (not shown) that are provided at several positions inside the fresh compartment 4.

The above temperature sensors are mounted on the rear and side walls of the fresh compartment 4 and sense the temperature in the compartment 4 prior to determining the opening degree of the damper device. The damper device thus controls the amount of cool air reaching the fresh compartment 4.

However, the above conventional cool air supply device is problematic due to the position of the cool air duct 9. That is, the above duct 9 is arranged on the rear wall of the fresh compartment 4, so that the cool air only flows from the rear of the fresh compartment 4 to the front of the fresh compartment 4. It is thus almost impossible to provide a sufficient amount of cool air to the area around the front portion of the fresh compartment 4 or the door baskets 8 of the fresh compartment 4. This negatively affects cooling change the foodstuffs in the front portion or in the door baskets 8. Thus, when repeatedly opening the door of the fresh compartment 4, atmospheric air rushes into the area around both the front portion and the door baskets 8 of the fresh compartment 4. The temperature around the front area of the fresh compartment 4 is therefore undesirably raised to a level higher than a preset point.

In order to overcome the above problem, a door duct may be arranged on the door of the fresh compartment 4 in addition to the above-mentioned cool air duct 9 provided on the rear wall of the compartment 4. An example of known refrigerators with such door ducts is disclosed in U.S. Pat. No. 5,584,191. In the refrigerator disclosed in the above U.S. patent, a door duct is formed on the door of the fresh compartment, thus allowing cool air from the evaporator to flow from the front to the rear in the fresh compartment. The refrigerator of the above U.S. patent also has a cool air duct on the rear wall of the fresh compartment in the same manner as described above. Therefore, the cool air also flows from the rear to the front in the fresh compartment. The above U.S. refrigerator somewhat uniformly cools the whole area in the fresh compartment in the three dimensions. The refrigerator also quickly cools the portion around the door baskets of the fresh compartment.

However, the above is designed for refrigerator is designed for continuously supplies a fixed amount of cool air to the fresh compartment, regardless of conditions of the compartment. That is, the amount of cool air provided to the fresh compartment is fixed regardless of the presence of foodstuffs inside the door baskets or a temperature difference between the areas in the fresh compartment. Therefore, the above refrigerator may fail to accomplish a designed cooling effect during its operation.

In a detailed description, new cooling load is added to the existing load in the fresh compartment which causes the temperature in the compartment to partially rise when some foodstuffs are newly stored in the front portion or door baskets of the fresh compartment. However, even in such a case, the cool air outlet passage of the door duct is not changed, but is fixed, so that the door duct fails to concentrically provide cool air to the hot portion of the compartment. This reduces the relatively cooling effect of the fresh compartment.

SUMMARY OF THE INVENTION

Accordingly, the present invention has been made keeping in mind the above problems occurring in the prior art, and an object of the present invention is to provide a concentrated cool air supply device for refrigerators, which is capable of concentrically guiding cool air from a door duct of a refrigerator to a hot area, newly loaded with foodstuffs, inside the fresh compartment of a refrigerator. This more effectively cooling such a hot area while uniformly cooling the interior of the compartment.

Another object of the present invention is to provide a concentrated cool air supply device for refrigerators which quickly and effectively cools a portion newly loaded with foodstuffs when the foodstuffs are newly stored in the door baskets of the fresh compartment.

In order to accomplish the above object, the present invention provides a concentrated cool air supply device for a refrigerator having at least one foodstuff storage cavity, a door for selectively closing the cavity, and a cool air passage for guiding cool air from an evaporator to a fresh compartment, comprising: a branch duct branched from the cool air passage and adapted for guiding cool air to the door; a door duct formed on the door to receive the cool air from branch duct, the door duct having a plurality of first air outlet openings formed on a cover plate; and mechanism for selectively opening the first outlet openings of the door duct to concentrically discharge cool air from the door duct into a desired portion of the storage cavity.

The device of this invention selectively opens the outlet openings of the door duct, thereby concentrically discharging the cool air from the door duct into a desired portion of the storage cavity. The device thus more effectively cools newly stored foodstuffs in the fresh compartment.

In the preferred embodiment of this invention, the opening mechanism comprises: a longitudinal slide panel having a plurality of second outlet openings and selectively sliding on the cover plate while coming into close contact with the cover plate, thus selectively opening the first outlet openings of the door duct by selectively aligning the first and second openings with each other; and a drive mechanism for selectively moving the slide panel back and forth on the cover plate.

The drive mechanism comprises: a motor; and a power transmission for converting the rotating force of the motor into a rectilinear reciprocating motion of the slide panel.

The power transmission comprises: a rotatable link coupled to the motor, thus being selectively rotated by the motor; and a connecting rod connected to the link and the slide panel at both ends.

In the embodiments of the present invention, the outlet openings of the door duct may be regularly formed along a horizontal line or a long a door basket provided on an inside of the door. Therefore, it is possible to horizontally supply cool air into the fresh compartment. The device also selectively supplies cool air into a desired portion of the door basket newly loaded with foodstuffs.

The above device further comprises a plurality of temperature sensors. The sensors are used for sensing temperatures in the fresh compartment and output temperature signals to allow the slide panel to selectively slide on the cover plate in response to the temperature signals.

BRIEF DESCRIPTION OF THE DRAWINGS

The above and other objects, features and other advantages of the present invention will be more clearly understood from the following detailed description taken in conjunction with the accompanying drawings, in which:

FIGS. 6*a* to 6*e* are views showing the operation of the opening selection unit of this invention, in which:

FIG. 6*a* shows the unit with all the air outlet openings of the door duct being opened;

FIG. 6*b* shows the unit with the right openings being opened;

FIG. 6*c* shows the unit with the riddle openings being opened;

FIG. 6*d* shows the unit with the left openings being opened; and

FIG. 6*e* shows the device with all the air outlet openings of the door duct being completely closed;

FIGS. 7*a* and 7*b* are views of the temperature sensors included in the cool air supply device of this invention, in which:

FIG. 7*a* is a view showing the position of the sensors; and

FIG. 7*b* is a view showing a fresh compartment's door basket provided with the sensors.

DESCRIPTION OF THE PREFERRED EMBODIMENTS

Figure 1:
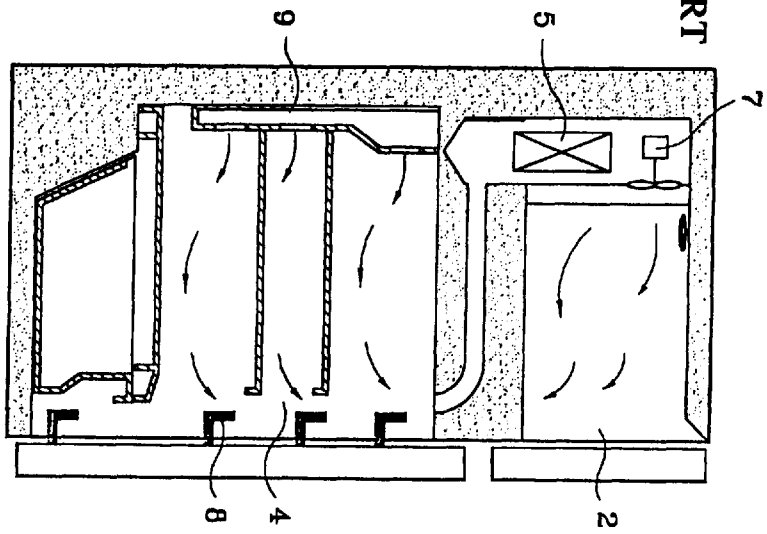
FIG. 1 CONVENTIONAL ART
FIG. 1 is a side sectional view of a refrigerator having a typical cool air supply device.
Figure 2:
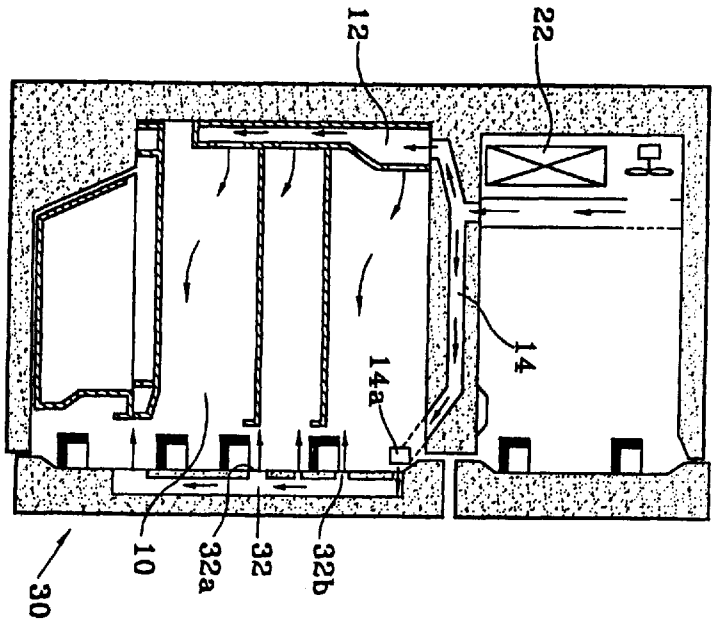
FIG. 2 is a side sectional view of a refrigerator provided with a cool air supply device in accordance with the present invention.
Figure 3:
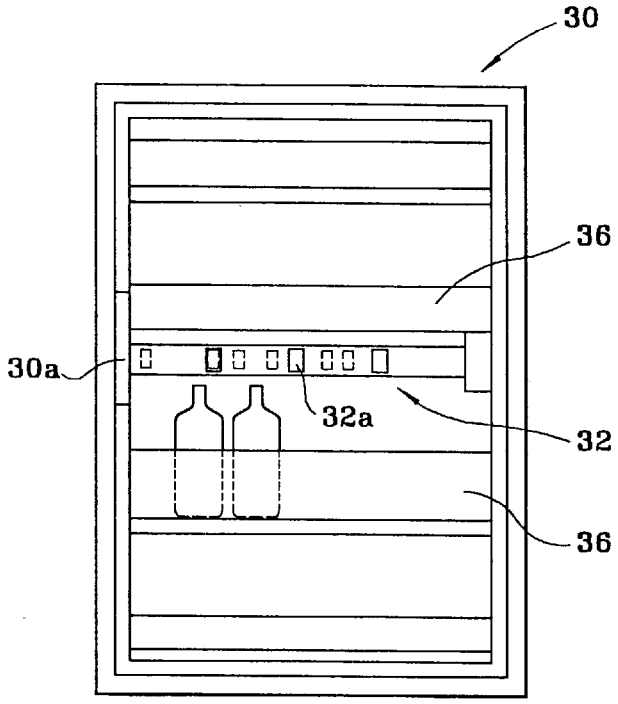
FIG. 3 is a front view showing the interior wall of the refrigerator door of the refrigerator shown in FIG. 2.

FIGS. 2 and 3 are views showing the construction of a refrigerator provided with a cool air supply device according to the present invention. As shown in the drawings, the cool air supply device of the present invention has a branch duct 14. The branch duct 14 is branched from the cool air passage extending from the evaporator 22 to the cool air duct 12 of the fresh compartment 10, and to the door duct 32 of the fresh door 30.

That is, the above branch duct 14 is designed for partially guiding the cool air from the evaporator 22 to the door duct 32 of the door 30. The outlet 14*a* of the above duct 14 is thus positioned at the front portion of the fresh compartment 10 so as to be selectively aligned with the inlet 32*b* of the door duct 32 when the door 30 is completely closed. Therefore, the cool air from the branch duct 14 is guided into the door duct 32 and is discharged into the fresh compartment 10 through the outlet openings 32*a* of the door duct 32, thus circulating cool air in a direction from the front to the rear portion of the compartment 10.

Figure 5:
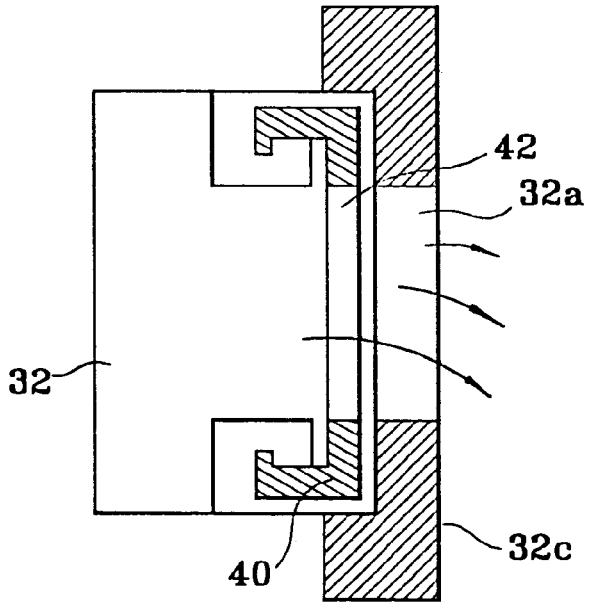
FIG. 5 is a sectional view of the above opening selection unit taken along the line B—B of FIG. 4.

As shown in FIGS. 3 and 5, the door duct 32 is formed in the door 30. In the embodiment of the drawings, the door duct 32 extends horizontally along the door baskets 36 of the door 30. A plurality of cool air outlet openings 32*a* are regularly formed on the inside wall of the door duct 32, thus discharging the cool air into the fresh compartment 10. In the embodiment of the drawings, the above outlet openings 32*a* are formed on a cover plate 32*c* which forms the inside wall of the door duct 32.

In a brief description, the branch duct 14, guides a portion of the cool air to the door duct 32 when the door 30 is completely closed. An appropriate number of cool air outlet openings 32*a* are formed on the inside wall of the door duct 32, thus discharging the cool air into the fresh compartment 10.

Figure 4:
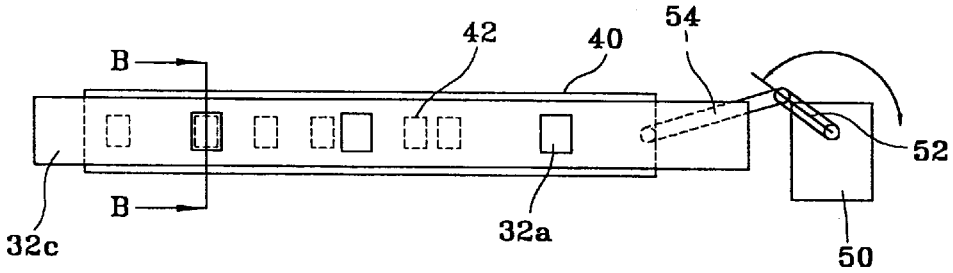
FIG. 4 illustrate the construction of the opening selection unit shown in the portion "A" of FIG. 3.

FIGS. 4 and 5 show the construction of the opening selection unit included in the device of this invention. The above selection unit is designed for allowing a user to freely select the cool air outlet openings 32*a* through which the cool air is discharged into the fresh compartment 10. That is, the cool air from the door duct 32 may be discharged into the compartment 10 through all the openings 32*a* or a part of the openings 32*a* by operating the selection unit in response to a cooling load inside the compartment 10. For example, when a new cooling load is created in the right side of a door basket 36, only the right openings 32*a* may be opened by handling the selection unit, thus allowing the cool air to be discharged from the door duct 32 into the compartment 10 through the right openings 32*a*. In such a case, it is possible to concentrically discharge the cool air to the right side of the basket 36 having the new cooling load. Of course, when a new cooling load is created in the left side of the door basket 36, it is equally possible to open the left openings 32*a* so as to concentrically discharge the cool air to the left side of the basket 36 having the new cooling load.

As shown in FIGS. 4 to 6*e*, the opening selection unit comprises a longitudinal slide panel 42 having a plurality of outlet openings 42. The unit also has a drive mechanism for selectively moving the panel 42 to the left or right. The above drive mechanism comprises a motor 50, a rotatable link 52 and a connecting rod 54. The link 52 is fixed to the output shaft of the motor 50 at one end, thus being rotatable by the rotating force of the motor 50. The above link 52 is also jointed to the connecting rod 54 at the other end. The above connecting rod 54 is jointed to one end of the slide panel 40. In the operation of the selection unit, the motor 50 starts to rotate the link 52 to a desired angular position, thus allowing the connecting rod 54 to move the slide panel 40 to a desired position.

In the preferred embodiment of this invention, the drive mechanism, comprising the motor 50, the link 52 and the rod 54, is designed for mechanically moving the panel 40 to the left or right. That is, the motor 50 generates a rotating force, while both the link 52 and the rod 54 convert the rotating force of the motor 50 into a linear reciprocating motion.

However, it should be understood that the mechanism for converting the rotating force of the motor 50 into such a linear reciprocating motion may be changed without affecting the functioning of this invention. For example, the slide panel 40 may alternatively be elastically held so as to be normally biased in a direction toward the motor 50 with the rotating force of the motor 50 being converted into a linear reciprocating motion by a conventional cam.

The above slide panel 40 is designed for selectively sliding on the cover plate 32*c,* having the outlet openings 32*a,* while coming into close contact with the plate 32*c*. The cool air discharging direction of the above selection unit is thus determined by whether the air outlet openings 32*a* of the cover plate 32*c* are aligned with the air outlet openings 42 of the slide panel 40.

The operational effect of the above selection unit will be described hereinbelow in detail.

As described above, the slide panel 40 has a plurality of air outlet openings 42, while the inside wall of the door duct 32 has a plurality of air outlet openings 32*a*. As shown in FIGS. 6*a* to 6*e,* the air outlet openings 42 and 32*a* are positioned as follows. That is, the openings 42 of the slide panel 40 may close all the openings 32*a* of the door duct 32 or open a part of the openings 32*a* in accordance with a position of the slide panel 40 relative to the door duct 32.

Figure 6A:
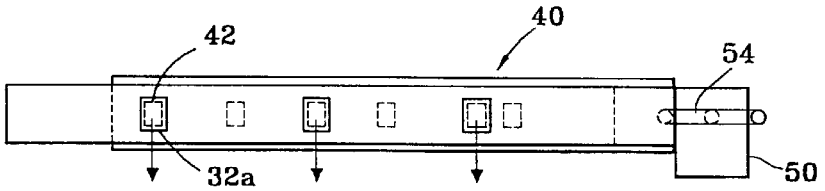

FIG. 6*a* shows the selection unit with all the air outlet openings 32*a* of the door duct 32 being opened. In such a case, all three openings 32*a* of the duct 32 are aligned with the openings 42 of the slide panel 40 respectively, thereby being completely opened. The cool air from the door duct 32 is thus fully discharged into the fresh compartment 10 through the three openings 32*a*.

In FIGS. 6*a* to 6*e,* the openings 32*a* of the door duct 32 are shown by the solid line, while the openings 42 of the slide panel 40 are shown by the phantom line.

Figure 6B:
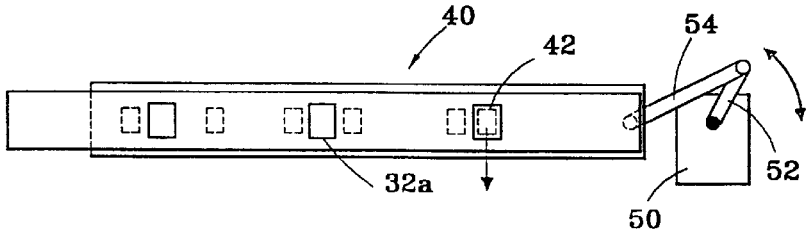
Figure 6C:
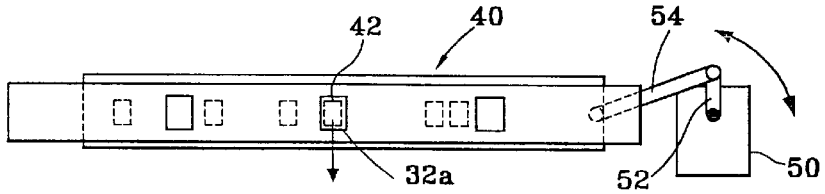
Figure 6D:
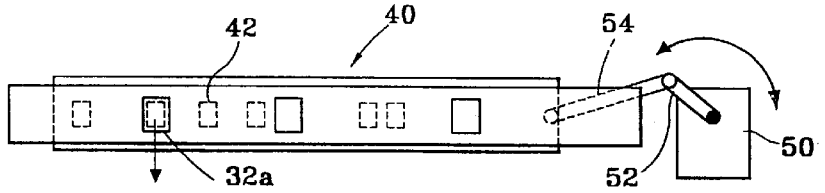
Figure 6E:
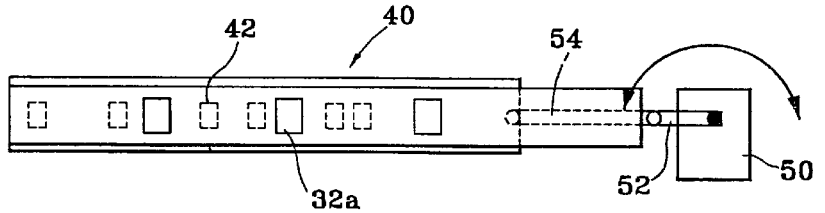

FIG. 6*b* shows the selection unit with only the right openings 32*a* of the duct 32 being aligned with the openings 42 of the panel 40 so as to be opened. In such a case, the cool air is discharged into the fresh compartment 10 only through the right openings 32*a*. FIG. 6*c* shows the selection unit with only the middle openings 32*a* being opened, while FIG. 6*d* shows the selection unit with only the left openings 32*a* being opened. FIG. 6*e* shows the selection unit with none of openings 32*a* being aligned with the openings 42. In such a case, all the air outlet openings 32*a* of the duct 32 are completely closed by the slide panel 40, so that the cool air is prevented from flowing in a direction from the front to the rear of the fresh compartment 10.

As described above, the position of the openings 32*a* of the door duct 32 is fixed, while the position of the openings 42 of the slide panel 40 is movable relative to the openings 32*a*. Therefore, it is possible to freely select the openings 32*a* by moving the slide panel 40 relative to the door duct 32. The cool air may be thus concentrically discharged into a portion of the fresh compartment 10 through the selected openings 32*a*.

In order to accomplish the position of the slide panel 40 relative to the door duct 32, both the link 52 and the connecting rod 54 convert the rotating force of the motor 50 into a linear reciprocating motion, thus moving the panel 40 on the fixed duct 32.

Figure 7A:
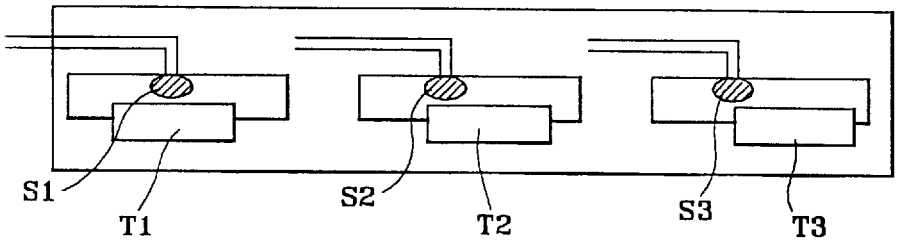
Figure 7B:
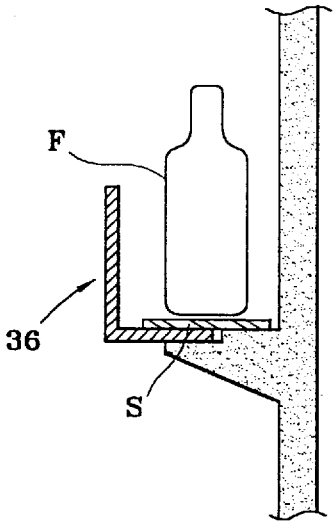

FIGS. 7*a* and 7*b* are views of temperature sensors "S" included in the cool air supply device of this invention. The above temperature sensors "S" are used for automatically moving the slide panel 40 to a desired position. As shown in FIG. 7*b* or a sectional view of a door basket 36, a plurality of temperature sensors S1, S2 and S3 are installed on the bottom of the door basket 36 for sensing a new cooling load in the basket 36. In the embodiment shown in the drawings, three openings 32*a* are formed on the door duct 32, it is preferable to install three sensors S1, S2 and S3 on the bottom of the basket 36. However, it should be understood that the number of the temperature sensors "S" may be changed in accordance with the number of the openings 32*a*.

The above sensors "S" are operated as follows.

When foodstuffs are newly stored in the fresh compartment 10, thus creating a new cooling load in the compartment 10, the sensors "S" sense the load and output signals to a control unit (not shown). Upon receiving the signals from the sensors "S", the control unit starts the drive motor 50, thus moving the slide panel 40 to a desired position. For example, when foodstuff are newly stored on a position around the third sensor S3 in the right portion of the door basket 36, the third sensor S3 senses that the temperature around the newly stored foodstuffs is higher than a preset point. The third sensor S3 thus outputs a signal to the control unit, so that the control unit starts the motor 50 so as to move the slide panel 40 to a position where the panel 40 only opens the right openings 32*a* of the door duct 32 as shown in FIG. 6*b*. Therefore, the cool air is concentrically discharged onto the newly stored foodstuffs and effectively cools the relatively warm foodstuffs. In the embodiment of FIG. 7*a,* a plurality of heat conduction plates T1, T2 and T3 are provided around the sensors "S", thereby allowing heat to be quickly conducted from the newly stored foodstuffs to the sensors "S".

In the preferred embodiment of this invention, the temperature sensors S are installed on the bottom of the door basket 36. However, it should be understood that such sensors S may be mounted on another position around the outlet openings 32*a* of he door duct 32 without affecting the functioning of this invention. That is, the temperature sensors "S" of this invention are designed for sensing the temperatures around the outlet openings 32*a* of the door duct 32 prior to controlling the openings 32*a*.

In the above embodiment, the slide panel 40 is horizontally movably mounted on a door basket 36 to be slidable along the basket 36. However, a plurality of slide panels 40 may be installed on the door baskets 36 of the fresh compartment 10, respectively. In addition, one slide panel 40 may be vertically installed across the door baskets 36. In such a case, the slide panel 40 selectively concentrically discharges cool air into a selected door basket 36 newly loaded with foodstuffs.

As described above, the present invention provides a concentrated cool air supply device for refrigerators. In accordance with the invention, a cool air duct is formed on the rear wall of the fresh compartment in the same manner as the prior art, thus discharging cool air from the rear to the front in the fresh compartment. In addition, a door duct is formed on the door of the fresh compartment, thus allowing the cool air to flow from the front to the rear in the fresh compartment. The cool air supply device of this invention thus uniformly cools the whole area in the fresh compartment in the three dimensions. More particularly, since the device allows the cool air to flow from the front to the rear in the fresh compartment, it is possible to quickly supply the cool air to the front portion of the fresh compartment around the door, thus effectively maintaining the door baskets and the portion around the baskets at a preset low temperature.

The device of this invention has a slide panel capable of concentrically discharging the cool air into a part of the door baskets when foodstuffs are newly stored in a door basket to create a new cooling load in the basket. The device thus quickly accomplishes a desired and uniform cooling effect for the fresh compartment.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. In a refrigerator including a storage cavity and a door for selectively closing the storage cavity, the door including at least one storage basket on an interior side thereof, a system for selectively providing cool air to an interior of the refrigerator, comprising:

a cool air source;

a branch duct for guiding cool air from said cool air source;

a door duct formed in the door and connected to said branch duct when the door is closed, said door duct having at least one opening on an interior surface of the door along the at least one storage basket; and a damper mechanism constructed and arranged to selectively close off said at least one opening.

2. The system according to claim 1, wherein said door duct includes a plurality of openings formed along a first end, an intermediate portion, and a second end of the at least one storage basket, said damper mechanism being constructed and arranged to selectively close off at least one of:

said openings along said first end and said intermediate portion of the storage basket;

said openings along said second end and said intermediate portion of the storage basket;

said openings along said first and second ends of the storage basket; and said openings along said first end, said intermediate portion, and said second end of said storage basket.

3. The system according to claim 1, wherein said door duct includes a plurality of openings formed along the at least one storage basket, said damper mechanism being constructed and arranged to selectively leave all of said openings open simultaneously.

4. The system according to claim 1, wherein said damper mechanism comprises:

a movable slide panel having at least one opening formed therein corresponding to said at least one opening of said door duct, said slide panel selectively closing off said at least one opening of said door duct depending on a position of said at least one opening of said slide panel relative to said at least one opening of said door duct; and a drive mechanism constructed and arranged to selectively move said slide panel.

5. The system according to claim 4, wherein said drive mechanism comprises a motor and a transmission for converting rotational power of said motor into linear force for moving said sliding panel.

6. The system according to claim 5, further comprising at least one temperature sensor located in an interior of said storage cavity, said motor being operable in accordance with a temperature sensed by said at least one temperature sensor.

7. The system according to claim 2, wherein said damper mechanism comprises:

a movable slide panel having openings formed therein corresponding to said openings along said first end, said intermediate portion, and said second end of the storage basket said slide panel selectively closing off one or more of said openings of said door duct depending on a position of said openings of said slide panel relative to said openings of said door duct; and a drive mechanism constructed and arranged to selectively move said slide panel.

8. The system according to claim 7, wherein said drive mechanism comprises a motor and a transmission for converting rotational power of said motor into linear force for moving said sliding panel.

9. The system according to claim 8, further comprising temperature sensors located at said first end, said intermediate portion, and said second end of said at least one storage basket, said motor being operable in accordance with temperatures sensed by one or more of said temperature sensors.

10. A method for providing cool air to a portion of a storage basket located on an interior of a refrigerator door, comprising:

guiding cool air to a plurality of openings distributed along a length of the storage basket; and selectively closing off at least some of the openings to guide cool air to a particular portion of the storage basket.

11. The method according to claim 10, wherein selectively closing off at least some of the openings comprises at least one of:

selectively closing off the openings located along a first end and an intermediate portion of the storage basket;

selectively closing off the openings located along a second end and an intermediate portion of the storage basket; and selectively closing off the openings located along the first and second ends of the storage basket.

12. The method according to claim 11, comprising detecting a temperature at the first end, the intermediate portion, and the second end of the storage basket, wherein selectively closing off at least some of the openings depends on a temperature detected at the first end, the intermediate portion, and the second end of the storage basket.

* * * * *